United States Patent [19]

Leaming

[11] Patent Number: 4,636,776

[45] Date of Patent: Jan. 13, 1987

[54] ALARM SYSTEM FOR SPACE HEATING APPLIANCES

[76] Inventor: Roger M. Leaming, 2309 Don St., Springfield, Oreg. 97477

[21] Appl. No.: 723,333

[22] Filed: Apr. 15, 1985

[51] Int. Cl.[4] ..... G08B 17/06

[52] U.S. Cl. ..... 340/594; 340/688; 374/206

[58] Field of Search ..... 340/688, 594; 374/206

[56] References Cited

U.S. PATENT DOCUMENTS 2,771,775 11/1956 Argabrite ..... 374/208 X 3,533,289 10/1970 Douglas ..... 340/688 X

*Primary Examiner*—James L. Rowland

*Assistant Examiner*—Thomas J. Mullen, Jr.

*Attorney, Agent, or Firm*—James D. Givnan, Jr.

[57] ABSTRACT

A housing for attachment to a space heating appliance and having a terminal assembly receiving a two conductor plug. The terminal assembly is positionable arcuately on the housing and includes a contact closed upon expansion of a bimetallic coil. The coil additionally drives a temperature indicator. A signal generator unit is remote from the first mentioned housing and is in circuit therewith via a two conductor cable.

2 Claims, 4 Drawing Figures

ALARM SYSTEM FOR SPACE HEATING APPLIANCES

BACKGROUND OF THE INVENTION

The present invention pertains generally to alarm system for alerting a resident of the presence of excessive temperatures within a heating appliance such as a wood stove or fireplace insert.

With the increase in popularity of wood stoves and wood burning fireplace inserts has come an increase in home fires resulting from excessive temperatures which may be high enough to ignite adjacent wall structures not adequately spaced from the appliance or adequately protected by insulation. Another risk encountered in the heating of a home by a solid fuel burning appliance is that of a flue fire caused by the ignition of deposits on the exhaust pipe and/or chimney. While heat indicating thermostats are available for installation on stove surfaces, such as that device shown in U.S. Pat. No. 4,305,289, the same require periodic monitoring by the user which is impractical. Additionally, surface temperatures of stoves and fireplace inserts may reach a level as to cause injury upon accidental contact therewith.

Surface mounted thermometers include those disclosed in U.S. Pats. No. 2,771,775; 1,824,933 and 2,456,062 all of which are considerably more complex than the present alarm system.

SUMMARY OF THE PRESENT INVENTION

The present invention is embodied within an alarm system for use in conjunction with a home heating appliance which alerts the home owner of excessive surface temperatures of an appliance.

The present system includes a sensor assembly for placement on a space heating appliance such as a wood stove or fireplace insert and having a signal generating unit activated upon the sensing of extreme temperatures. The sensor assembly housing is adapted for selective placement on an appliance surface to enable the most critical temperature area of the appliance to be monitored. The signal generating unit of the system includes a housing for remote dispostion from the sensor assembly to avoid damage by the appliance generating heat. Conductor means couples the sensor assembly to said signal generating unit.

A terminal assembly is adjustably mounted on a sensor assembly housing to permit the user to select the temperature set point at which the alarm system will be activated. A bimetallic coil of the system may additionally serve as an electrical conductor to simplify assembly of the device. Attachment of the sensor assembly housing to the appliance is preferably by a magnet in place on the rear side of the housing.

Objectives of the present invention include the provision of an alarm system adpated for use with home heating appliances to detect the presence of excessive surface temperatures and complete a circuit to signal generating means which may be remote from the appliance; the provision of an alarm system having a sensor assembly attachable to a heating appliance surface in a selective manner without alteration of the surface; the provision of an alarm system which provides an audible signal in the event a selected temperature set point is reached within a heating appliance to obviate periodic inspection of a temperature indicator on the appliance; the provision of an alarm system of an uncomplicated and highly reliable nature for use in those homes heating by solid fuel burning appliances.

DETAILED DESCRIPTION OF THE PREFERRED EMBODIMENT

Figure 1:
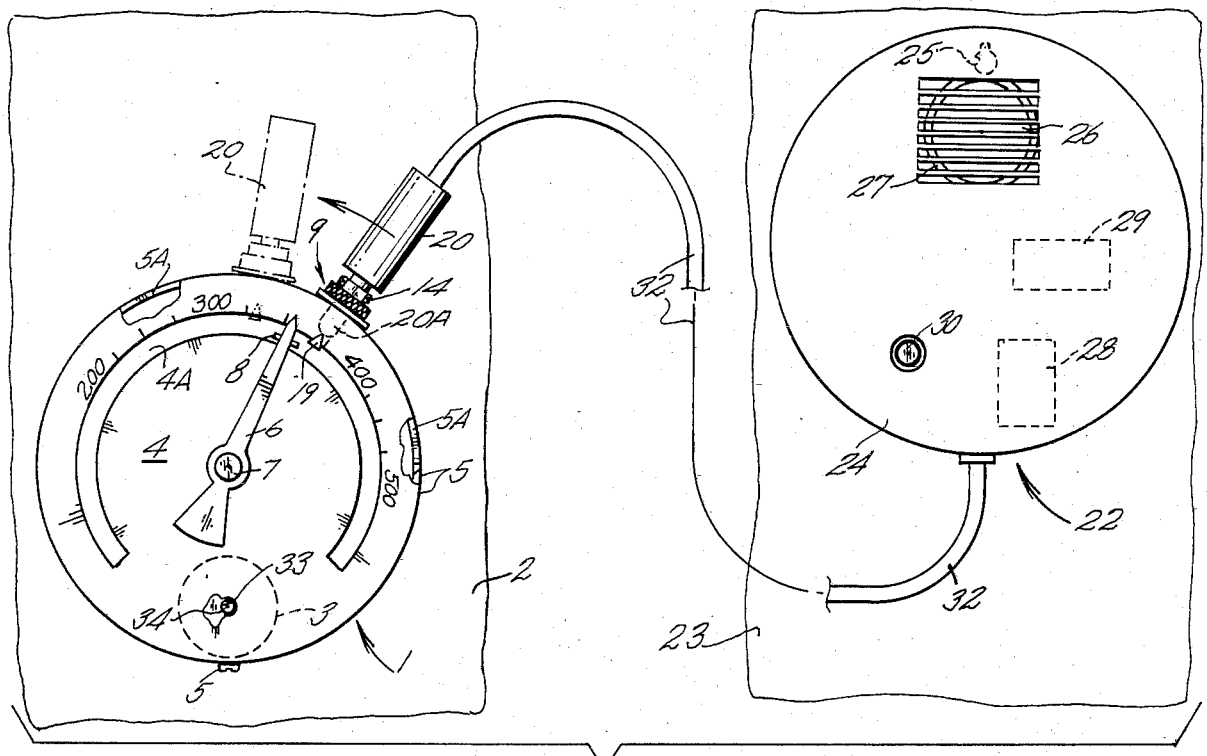
Fig. 1 is an elevational view of the present alarm system operatively disposed.
Figure 2:
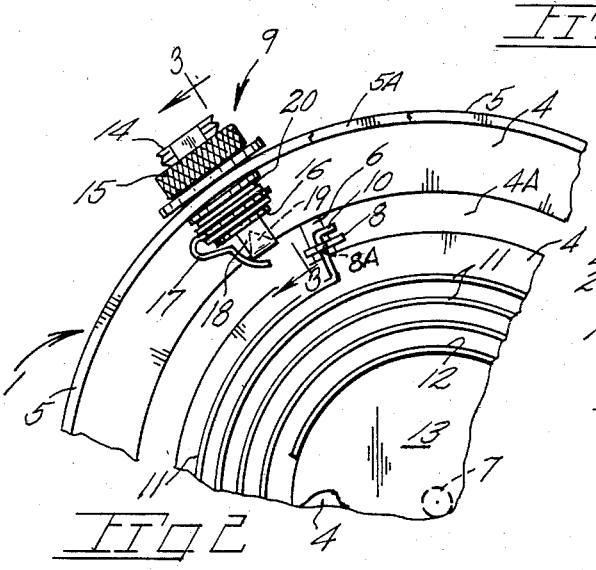
FIG. 2 is an enlarged fragmentary rear elevational view of the sensor assembly housing.
Figure 3:
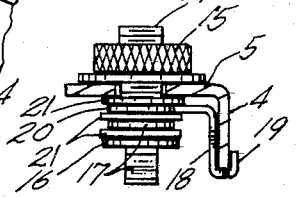
FIG. 3 is an elevational view of a terminal assembly taken along 1ine 3—3 of FIG. 2.
Figure 4:
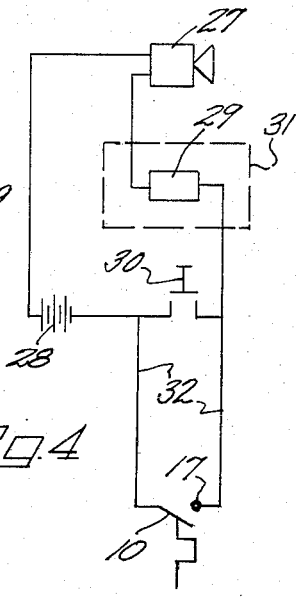
FIG. 4 is an electrical schematic of the system. cl

With continuing attention to the drawing wherein applied reference numerals indicate parts similarly hereinafter identified, the reference numeral 1 indicates generally a sensor assembly of the alarm system.

Sensor assembly 1 is adapted for placement on an exterior wall surface 2 of a space heating appliance as for example a wood stove or fireplace insert. For this purpose a permanent magnet 3 may be concealed within a sensor assembly housing 4 and attached thereto by a fastener 5A. Such magnetic attachment permits convenient, selective placement of the housing on a vertical wall surface without alteration of the wall surface. In certain instances it may be desirable to position housing 4 on a horizontal surface of an appliance or any other surface whereat maximum surface temperatures are encountered. An annular wall 5 of the housing defines a slot 5A extending partially thereabout while the frontal face of housing 4 defines an opening 4A. A marginal area of housing face 4 adjacent opening 4A bears temperature markings covering the range of appliance surface temperatures.

A pointer at 6 is swingable about a pivot 7 in response to temperature changes as later explained. Pointer 6 is equipped near its distal end with a perpendicular appendage or plate 8 having an elongate opening 8A therein to loosely receive a radially outwardly turned end segment 10 of a bimetallic coil 11 which may move in an unhindered manner for purposes of accuracy. The remaining or inner end segment 12 of coil 11 is suitably secured to a boss 13 integral with housing 4.

A terminal assembly, generally at 9, is mounted in slot 5A and includes a socket 14 threaded on its exterior to receive a nut element 15 which urges the inner or innermost, enlarged end 16 of the socket outwardly to clamp the terminal assembly in place on housing wall 5. Said assembly, upon backing off of nut element 15, is slidably positionable within arcuate slot 5A about pivot 7. Said terminal assembly further includes a spring arm contact 17 disposed to receive an end 20A of a two conductor phone of plug 20 inserted through socket 14. Socket 14 is grounded to the housing by means of an arm 18 which is integral with a ring portion 20 in place about socket 14. Insulative washers are at 21. Arm 18 terminates in a set point marker at 19. From the foregoing it will be seen that upon loosening of nut 15 the terminal assembly may be positioned along arcuate wall 5 to locate a set point marker 19 of the assembly at a selected temperature indices printed on the housing adjacent opening 4A. Contact 17 is simultaneously located for closure upon advancement of the coil end segment. A continuous temperature indication is provided by pointer 6 as it is moved by end segment 10 of the coil. This dual purpose feature of indicator 6 provides an alarm system which, in addition to activating a warning signal, continuously aprises the appliance user of surface temperatures to permit remedial measures to reduce appliance temperatures.

A signal generator unit is indicated generally at 22 and is intended for placement on a surface away from extreme temperatures as for example on a room wall surface 23. A housing 24 of the unit is provided with suitable wall attachment means 25 and defines an open area 26 behind which is a speaker 27. A power source may be a low voltage dry cell battery 28 in circuit with oscillator means 29 and a signal generator such as a speaker 27. A push-to-test button at 30 may serve to bypass the electrical components in the terminal assembly for purposes of verifying the operable condition of the signal generator unit. The oscillator means 29 may be conveniently embodied in a module 31 sold by Radio Shack store outlets as a Morse code practice module.

A two conductor, insulated cable 32 couples plug 20 to the signal generator unit.

In use the sensor assembly 1 is mounted inconspicuously on an appliance surface such as the back wall of a wood stove below the outlet. The signal generator unit is adapted for placement on a remote, relatively cool wall surface 23 and hence may be of low cost construction not unlike existing smoke alarms now in wide use in homes. The set point at which speaker 27 will be energized is selected by the user by the positioning of the terminal assembly along wall 5 of the sensor assembly housing and upon an increase in temperature to close the terminal contact.

The housing 4 may be apertured at 33 with magnet 3 having an aligned aperture 34 to permit sensor assembly 1 to be secured to a surface by a mounting fastener (not shown).

While I have shown but one embodiment of the invention, it will be apparent to those skilled in the art that the invention may be embodied still otherwise without departing from the spirit and scope of the invention.

I claim:

1. An alarm system for signaling the presence of excessive surface temperatures in a fuel burning appliance, said system comprising, a sensor assembly including a housing having an annular outer wall, a bimetallic coil having a radially outwardly turned end segment, a terminal assembly adjustably mounted on the housing outer wall and including a set point marker and a contact for location in a path of travel of said end segment of the coil and contactible by said coil end segment and through which an electrical circuit is established upon expansion of the coil during an increase in the surface temperature of the appliance, a pointer rotatably mounted on the housing and including a plate defining an opening through which said coil end segment passes in an unrestricted manner for imparting movement to the pointer without obstructing coil expansion, a signal generator unit including a second housing for remote disposition from the sensor assembly, a signal generator, a power source, and conductor means in circuit with said terminal assembly and said signal generator unit to activate the signal generator upon closure of the terminal assembly contact.

2. The alarm system claimed in claim 1 wherein said housing includes attachment means for housing attachment to the appliance, said attachment means including a magnet defining an opening for the reception of a fastener engageable with a housing supporting appliance.

* * * * *